United States Patent [19]

Jeschke et al.

[11] Patent Number: 4,747,348

[45] Date of Patent: May 31, 1988

[54] WASHING DEVICE FOR IMPRESSION CYLINDERS

[75] Inventors: Willi Jeschke, Heidelberg; Klaus Dürrnagel, Meckesheim, both of Fed. Rep. of Germany

[73] Assignee: Heidelberger Druckmaschinen, Heidelberg, Fed. Rep. of Germany

[21] Appl. No.: 43,950

[22] Filed: Apr. 29, 1987

[30] Foreign Application Priority Data

Apr. 29, 1987 [DE] Fed. Rep. of Germany ..... 3614496

[51] Int. Cl.[4] ..... B41F 35/00; B41L 41/00

[52] U.S. Cl. ..... 101/425

[58] Field of Search ..... 101/423, 424, 425; 15/DIG. 5, 256.51, 256.52

[56] References Cited

U.S. PATENT DOCUMENTS

| | | | |
|---|---|---|---|
| 3,049,997 | 8/1962 | Grembecki et al. | 101/425 |
| 3,120,805 | 2/1964 | Simon | 101/425 |
| 4,015,307 | 4/1977 | Kossak | 101/425 |
| 4,066,017 | 1/1978 | Garcowski et al. | 101/425 |
| 4,090,445 | 5/1978 | Sassi | 101/425 |
| 4,270,450 | 6/1981 | Difflipp et al. | 101/425 |
| 4,344,362 | 8/1982 | Ishii | 101/425 |
| 4,393,778 | 7/1983 | Kaneko | 101/425 |

FOREIGN PATENT DOCUMENTS

| | | | |
|---|---|---|---|
| 2032848 | 3/1980 | United Kingdom | 101/425 |

OTHER PUBLICATIONS

*Xerox Disclosure Journal;* Barisone, Lange, Oszczakiewicz, "Cleaner With Uniform Air Flow"; 8-1979.

*Primary Examiner*—Charles Pearson

*Attorney, Agent, or Firm*—Herbert L. Lerner; Laurence E. Greenberg

[57] ABSTRACT

In a washing device for an impression cylinder of a printing machine, there is provided a washing roller capable of being brought into contact with and liftable away from a cylindrical jacket surface of the impression cylinder in vicinity of a gripper bridge of the impression cylinder, and being sprayable with cleaning solution, the washing roller comprising a washing brush extending over substantially the entire length of the impression cylinder and being separately driven, the washing roller being rotatable in a direction opposite the direction of rotation of the impression cylinder and being rotatable at a higher speed than the rotating speed of the impression cylinder, the washing roller being movable automatically into its contact with the impression cylinder.

9 Claims, 1 Drawing Sheet

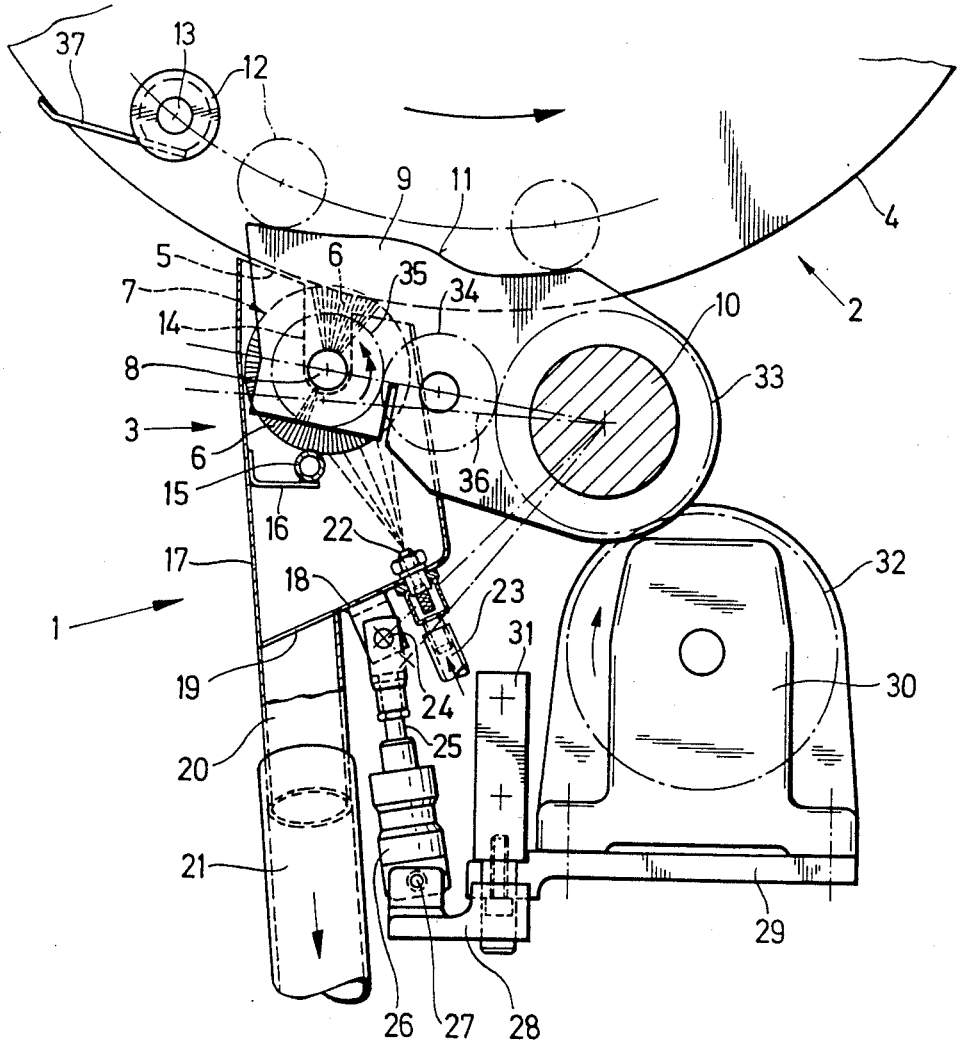
37
13
12
9
11
4
5
6
35
34
7
14
10
2
8
33
3
6
15
36
16
22
17
18
23
32
1
31
19
24
30
25
20
21
29
26
27
28

WASHING DEVICE FOR IMPRESSION CYLINDERS

Specification:

The invention relates to a washing device for an impression cylinder of a printing machine, in particular an offset printing machine equipped with a washing roller, which is able to be brought into contact with and liftable away from a cylindrical jacket surface of the cylinder in vicinity of a gripper bridge of the impression cylinder, and being sprayable with cleaning solution.

A device for washing cylinders in printing machines, in particular offset printing machines, and mainly used to clean rubber or blanket cylinders is known from DE-OS No. 28 15 388. Such a device can, however, also be set manually in contact with the impression cylinder. The washing roller of this device, which is provided with a soft coating, is entrained by friction in the in-contact position. To intensify the cleaning process, a washing medium or solution can be sprayed onto the washing roller. A control cam mounted on the impression cylinder in the vicinity of the grippers serves the purpose of lifting-away the washing roller from the jacket surface of the impression cylinder so that the washing roller does not collide with the grippers.

Setting the device in-contact with the impression cylinder manually for washing is time consuming for the printer, in particular because he can only wash one impression cylinder at a time. Furthermore, a relatively long cleaning time must be assumed because the washing roller is entrained by friction so that no abrasive action or scouring effect, which would otherwise promote cleaning, can occur on the jacket surface of the impression cylinder.

It is an object of the invention to provide a washing device for impression cylinders which will perform a cleaning thoroughly, rapidly and with a minimum of effort on the part of the printer.

With the foregoing and other objects in view, there is provided, in accordance with the invention, in a washing device for an impression cylinder of a printing machine, a washing roller capable of being brought into contact with and liftable away from a cylindrical jacket surface of the impression cylinder in vicinity of a gripper bridge of the impression cylinder, and being sprayable with cleaning solution, the washing roller comprising a washing brush extending over substantially the entire length of the impression cylinder and being separately driven, the washing roller being rotatable in a direction opposite the direction of rotation of the impression cylinder and being rotatable at a higher speed than the rotating speed of the impression cylinder, the washing roller being movable automatically into its contact with the impression cylinder.

The washing brush, moistened with washing solution and rotating in a direction opposite the direction of rotation of and at a relatively higher speed than that of the impression cylinder, removes dirt deposits, such as paper dust, ink residue or streaks or nap of paper from the jacket surface of the impression cylinder at an extremely fast rate. Generally, the washing period has a duration of only 50 to 60 seconds. The washing operation can be repeated at any time. The rotation of the washing brush, which opposes the direction of rotation of the impression cylinder, produces the largest possible relative movement and therefore an effective abrasive effect or scouring action. The separate drive of the washing brush permits optimum speed adjustment.

In accordance with another feature of the invention, the washing brush is slightly cambered so as to counteract sagging thereof and to ensure a constant abrasive or scouring pressure over the entire length of the impression cylinder. To prevent the formation of mist and corresponding effects of moisture on surrounding parts of the printing machine, in accordance with a further feature of the invention the washing brush is housed in a collecting trough open only towards the jacket surface of the impression cylinder, and is rotatable in a manner that, in an adjustment contact position of the washing brush, bristle tips of the washing brush are in intensive contact with the jacket surface of the impression cylinder.

In accordance with a further feature of the invention, the washing device includes a plurality of spray nozzles for applying washing solution to the washing brush during a washing operation, said spray nozzles being arranged in said collecting trough, parallel to the washing brush and spaced at regular intervals from one another. In this way, wetting of the washing brush can be measured very well, while avoiding local overmoistening or undermoistening. Economical use of the washing medium is made possible in conjunction with optimum efficiency of the washing brush. The jacket surface of the impression cylinder is thus moistened only to such an extent as is just necessary to remove the dirt and other impurities.

In accordance with an added feature of the invention, a yieldable adjusting device is provided and, through the intermediary thereof, the collecting trough is movable into contact with the impression cylinder. The adjusting device may be pneumatically operable. This makes it possible to arrange on the gripper bridge of the impression cylinder an adjustment element which cooperates with an adjusting element acting upon the washing brush in a way that the washing brush is lifted over the gripper bridge when in the contacting position. The hereinafore mentioned yieldable in-contact setting capability of the washing brush in conjunction with the corresponding adjustment facilities affords fully automatic contacting adjustment of the washing brush. For this purpose then, only an electronic control device with a selection system would be required for facilitating simultaneous washing by selecting a given number or all of the impression cylinders on the printing machine. The washing interval remains unaffected by the number of impression cylinders to be cleaned. It always amounts to approximately 50 to 60 seconds.

Other features which are considered as characteristic for the invention are set forth in the appended claims.

Although the invention is illustrated and described herein as embodied in a washing device for impression cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing, which is a diagrammatic side elevational view, partly in section, of a washing device for impression cylinders in accordance with the invention.

Referring now to the single figure of the drawing, there is shown therein a washing device 1 according to the invention which is arranged beneath an impression cylinder 2 of an offset printing unit not otherwise illustrated in detail. An important component of this washing device 1 is a collecting trough 3 which has a rather rectangular cross section and which extends over the entire length of the impression cylinder 2. The trough 3 is open only at 5 towards the jacket surface 4 of the impression cylinder 2. Projecting through the opening 5 are bristles 6 of a roller-shaped washing brush 7 which also extends over the entire length of the impression cylinder 2 and which is preferably shaped slightly cambered. The diameter of the washing brush 7 is therefore slightly larger in the middle region of the impression cylinder 2 than at the edge regions thereof.

The shaft 8 of the washing brush 7 projects on both sides thereof into non-illustrated ball bearings which are mounted in bearing arms 9, only one of which is shown in the figure.

When viewed in axial direction of the impression cylinder 2, these bearing arms 9 are located, respectively, at the ends of the collector trough 3 immediately adjacent to the end faces of the impression cylinder. The bearing arms 9 are pivotally mounted on a sturdy, continuous pivot shaft 10. A web surface 11 of each of the bearing arms 9 faces towards the impression cylinder 2 and is curve shaped. Coming into contact with this surface 11 is a respective support roller 12 which is mounted outside or beyond the end face, respectively, of the impression cylinder 2 on a gripper shaft 13. The shaft 8 of the washing brush 7 projects through guide slots 14 formed in the side wall of the collector trough 3 and is mounted, positively locked therein.

A doctor blade 15 is arranged beneath the washing brush 7. It is formed of a tube which is secured by means of angles 16 to the side wall 17 of the collector trough 3. Consequently, the washing brush 7 is constantly cleaned automatically in a gentle manner by this tube-shaped doctor blade 15 because it always projects into the washing brush 7, thereby forcing and flinging the dirt out of its bristles 6.

A bottom wall or base 18 of the collector trough 3 is constructed so as to slope downwardly slightly in a direction opposite to the direction of rotation of the impression cylinder 2. Provided in the lowermost corner of the bottom wall 18 is a drain opening 19, to which there is connected a drain coupling 20 which feeds dirty washing solution to a non-illustrated collecting tank via a hose 21. Spray nozzles 22 are installed at regular intervals from one another in the upper region of the inclined bottom wall or base 18 of the collector trough 3. By means of a hose connection 23, the nozzles 22 are linked with a non-illustrated pump which removes the washing solution from a non-illustrated supply tank and feeds it to the spray nozzles 22 under pressure.

Located on the outside of the bottom wall or base 18 of the collector trough 3 is an eye-type or solid journal bearing 24, via which a control rod 25 of a pneumatic brush setting or adjusting device 26 is linked with the collector trough 3. The pivot axis of this eye-type or solid journal bearing 24 extends parallel to the axis of rotation of the impression cylinder 2. The pneumatic brush setting device 26 is basically formed of a cylinder and a piston which can be adjusted in two end positions. The piston, which is not visible in the figures is fixed to the control rod 25. At its lower end, the pneumatic brush setting device 26 is held articulatingly by a bearing bracket 28 through the intermediary of a further journal bearing 27. This bearing bracket 28 is firmly bolted to a base bracket or pad 29 of an electric motor 30. In turn, the base bracket 29 of the electric motor 30 is secured by means of a sturdy stirrup or strap 31 to a non-illustrated frame wall of the printing machine.

The drive of the washing brush 7 is effected by the electric motor 30, indeed transmitted through its drive spur gear 32 via a first intermediate spur gear 33, a second small intermediate spur gear 34 and finally via a spur gear 35 mounted on the shaft 8 of the washing brush 7. The first intermediate spur gear 33 is mounted so that it can rotate in non-illustrated ball bearings on the continuous, sturdy shaft 10, while the two remaining spur gears 34 and 35 are rotatably mounted via non-illustrated ball bearings in the bearing arm 9.

Due to the articulating support of the collecting trough 3 on the eye-type or solid journal bearing 24 on the control rod 25 as well as due to mounting the shaft 8 in the bearing arm 9 which is swivellable about the continuous shaft 10 as shown by the dot-dash lines, the collector trough 3 with the washing brush 7 arranged therein can be swivelled through approximately 6° to 7° about the axis of rotation of the continuous shaft 10 so as to move the washing brush 7 into and out of contact with the jacket surface 4 of the impression cylinder 2.

The operating principle of the aforedescribed device is as follows: Normally, the collecting trough 3 is located in its out of contact position (i.e. moved away from the impression cylinder 2). The axis of rotation of the shaft 8 of the washing brush 7 is then on the lower dot-dash line identified by reference numeral 36 and extending from the axis of rotation of the shaft 10. The figure, however, shows the set in-contact position of the washing device 1. The piston of the pneumatic brush setting device 26 is located in its upper position and, via the control rod 25 and the eye-type or solid journal bearing 24, has shifted the collector trough 3 about the axis of rotation of the shaft 10 into the upper position as shown. The bristles 6 of the washing brush 7, as illustrated, come into intensive contact with the jacket surface 4 of the impression cylinder 2 which rotates at slow speed.

Prior to bringing the collecting trough 3 into the contact setting thereof, the electric motor 30 starts to rotate the washing brush 7, via the illustrated drive assembly 33-35, preferably to a speed of 233 rpm. The direction of rotation of the washing brush 7 is opposite that of the impression cylinder 2. The double headed arrow shown on the washing brush 7 signifies that the speed of the washing brush 7 is considerably higher than that of the impression cylinder 2. Shortly before the bristles 6 of the washing brush 7 make contact with the jacket surface 4 of the impression cylinder 2, suitably metered washing solution is sprayed out of the adjustable spray nozzles 22 onto the bristles 6. A non-explosive solvent is preferably used as the washing solution. The doctor blade 15 ensures that dirty washing solution removed once again from the jacket surface of the impression cylinder 2 is injected or sprayed into the collector trough 3 and flows into the non-illustrated collector tank via the drain opening 19, the drain coupling 20 and the hose 21.

To ensure, during rotation of the impression cylinder 2, that the washing brush 7 does not collide with the grippers 37 of the gripper bridge of the impression cylinder 2, the support roller 12 arranged on the gripper shaft 13 runs onto the curved web surface 11 which is formed in such a way that the washing brush 7, naturally together with the collector trough 3, is briefly swivelled away into the lower dot-dash position 36 so that the grippers 37 can pass over without coming into contact with the bristles 6 of the washing brush 7. Immediately after the gripper bridge of the impression cylinder 7 has passed, the washing brush 7 is once again set against the jacket surface 4 of the impression cylinder 2. The two dot-dash or phantom representations of the support roller 12 show the start and the end of the brief lifting away of the washing device 1. The opposite direction of rotation of the washing brush 7, its relatively high rotary speed and the continuously cleaned and re-moistened bristles facilitate extraordinarily rapid cleaning of the jacket 4 of the impression cylinder 2. Because the washing device is arranged at a location, at which the impression cylinder 2 does not carry a sheet of paper and because the jacket surface 4 of the impression cylinder 2 is moistenable with washing solution rather extremely sparingly, the impression cylinder can be cleaned also during operation of the printing machine.

A variation of the represented embodiment is conceivable, in that the curved web section 11 of the bearing arm 9 may be made adjustable in radial direction with respect to the impression cylinder 2 so that the lifting-away movement can be adapted or matched to different types of gripper bridges.

The foregoing is a description corresponding in substance to German Application No. P 36 14 496.7, dated Apr. 29, 1986, the International priority of which is being claimed for the instant application, and which is hereby made part of this application. Any material discrepancies between the foregoing specification and the aforementioned corresponding German application are to be resolved in favor of the latter.

We claim:

1. In a washing device for an impression cylinder of a printing machine having an impression cylinder with a gripper bridge, a washing roller, means for bringing the washing roller into contact with and for lifting the washing roller away from a cylindrical jacket surface of the impression cylinder in vicinity of a gripper bridge of the impression cylinder, and means for spraying the washing roller with cleaning solution, the washing roller comprising a washing brush extending over substantially the entire length of the impression cylinder, means for driving the washing roller independently of the impression cylinder so that the washing roller is rotatable in the same direction of rotation as but at a higher speed than that of the impression cylinder and so that respective mutually opposing adjacent locations of said washing brush and said cylindrical jacket surface are travelling in opposite directions, and means for moving the washing roller automatically into its contact with the impression cylinder, said means for driving the washing roller comprising a motor firmly mounted on a frame wall of the printing machine, said motor having a shaft journal whereon a drive spur gear is fastened, said drive spur gear meshing, via two intermediate spur gears, with a spur gear fixed to a shaft of the washing brush for driving the brush, said intermediate spur gear immediately following said motor having a shaft on which an end of a respective bearing lever is mounted so as to be pivotable about the axis of said last-mentioned intermediate spur gear, the other end of the respective bearing lever being likewise rotatably mounted on said shaft of the washing brush, said bearing lever having a surface facing towards the impression cylinder and formed as a cam cooperatively engageable with a support roller mounted on the gripper shaft of the gripper bridge carried by the impression cylinder.

2. Washing device according to claim 1, wherein the washing brush is slightly cambered.

3. Washing device according to claim 1, wherein the washing brush is arranged in a collecting trough open only towards the jacket surface of the impression cylinder and is rotatable in a manner that, in an adjusted contact position of the washing brush, bristle tips of the washing brush are in intensive contact with the jacket surface of the impression cylinder.

4. Washing device according to claim 3 wherein said spraying means comprise a plurality of spray nozzles for applying washing solution to the washing brush during a washing operation, said spray nozzles being arranged in said collecting trough, parallel to the washing brush and spaced at regular intervals from one another.

5. Washing device according to claim 3, including a yieldable adjusting device through the intermediary of which said collecting trough is movable into operational proximity with the impression cylinder.

6. Washing device according to claim 5, including means for pneumatically operating said yieldable adjusting device.

7. Washing device according to claim 3, including a wiper fixed in said collecting trough in vicinity of said bristle tips.

8. Washing device according to claim 3, wherein said collecting trough has a bottom wall wherein a drain for used washing solution is located.

9. Washing device according to claim 1, wherein said motor has a base bracket whereon a bearing bracket is mounted, and including a pneumatic brush setting device, basically comprising a piston and a cylinder, pivotally linked to said bearing bracket and adjustable into two end positions, said setting device incuding a control rod connected at one end to said piston and at the other end articulatingly to said collecting trough.

* * * * *

UNITED STATES PATENT OFFICE

CERTIFICATE OF CORRECTION

PATENT NO. : 4,747,348

DATED : May 31, 1988

INVENTOR(S) : Jeschke et al

It is certified that error appears in the above-identified patent and that said Letters Patent is hereby corrected as shown below:

In the Title Page, Item 30, "Apr. 29, 1987 (DE)"
should read
- - Apr. 29, 1986 (DE) - - .

Signed and Sealed this
Eighteenth Day of July, 1989

*Attest:*

DONALD J. QUIGG

*Attesting Officer*

*Commissioner of Patents and Trademarks*